US008476831B2

(12) United States Patent
Lapatovich

(10) Patent No.: US 8,476,831 B2
(45) Date of Patent: Jul. 2, 2013

(54) DIELECTRIC-LOADED FIELD APPLICATOR FOR EHID LAMPS AND EHID LAMP ASSEMBLY CONTAINING SAME

(75) Inventor: Walter P. Lapatovich, Boxford, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 170 days.

(21) Appl. No.: 13/147,220

(22) PCT Filed: Feb. 25, 2010

(86) PCT No.: PCT/US2010/025309
§ 371 (c)(1),
(2), (4) Date: Aug. 1, 2011

(87) PCT Pub. No.: WO2010/104682
PCT Pub. Date: Sep. 16, 2010

(65) Prior Publication Data

US 2011/0316419 A1 Dec. 29, 2011

Related U.S. Application Data

(60) Provisional application No. 61/159,005, filed on Mar. 10, 2009.

(51) Int. Cl.
*H01J 65/04* (2006.01)

(52) U.S. Cl.
USPC ..... 315/39

(58) Field of Classification Search
None
See application file for complete search history.

(56) References Cited

U.S. PATENT DOCUMENTS

| | | | | | |
|---|---|---|---|---|---|
| 3,936,776 | A | * | 2/1976 | Sundquist | 333/202 |
| 4,700,158 | A | * | 10/1987 | Dorsey | 333/202 |
| 4,894,591 | A | | 1/1990 | Witting | |
| 5,990,627 | A | | 11/1999 | Chen et al. | |
| 6,107,752 | A | | 8/2000 | Palmer et al. | |

OTHER PUBLICATIONS

International Search Report for PCT/US2010/25309, completed on Oct. 6, 2010 and mailed on Oct. 7, 2010.

* cited by examiner

*Primary Examiner* — Crystal L Hammond
(74) *Attorney, Agent, or Firm* — Robert F. Clark; Andrew Martin

(57) ABSTRACT

A dielectric-loaded field applicator and an EHID lamp assembly are provided wherein the applicator comprises a helical resonator having a cylindrical dielectric core and a helical conductor, the dielectric core having a helical groove extending along its surface substantially from end to end; the helical conductor being contained in the helical groove and connectable at one end to a power source, the dielectric core being comprised of a dielectric material having a relative permittivity greater than about 3, preferably polycrystalline alumina. The EHID lamp assembly includes two opposed dielectric-loaded applicators with a discharge vessel supported between them.

20 Claims, 2 Drawing Sheets

DIELECTRIC-LOADED FIELD APPLICATOR FOR EHID LAMPS AND EHID LAMP ASSEMBLY CONTAINING SAME

CROSS REFERENCES TO RELATED APPLICATIONS

This present application claims the priority of U.S. Provisional Application No. 61/159,005, filed Mar. 10, 2009 and PCT Application No. PCT/US2010/025309 filed Feb. 25, 2010, the entire contents of both of which are hereby incorporated by reference.

TECHNICAL FIELD

This invention relates to electrodeless high intensity discharge (EHID) lamps and more particularly to field applicators for such lamps.

BACKGROUND OF THE INVENTION

The miniaturization of high intensity discharge (HID) lamps requires fabrication, placement and sealing of electrodes in tiny discharge vessels (also referred to as arc tubes or burners). Such HID arc tubes typically consist of transparent quartz or translucent polycrystalline alumina (PCA) bodies in which it is difficult to obtain hermetic seals, particularly at the smaller dimensions in low-wattage HID lamps. The high manufacturing costs of the electrode parts and high shrinkage due to manufacturing, placement, and handling issues further increase the difficulties encountered in mass producing low-wattage electroded HID lamps.

Electrodeless HID lamps offer an opportunity to have high speed, low cost, superior maintenance, precision lamps for low wattage applications since the associated problems with electrodes are eliminated. However, EHID lamps present a different set of problems which are primarily associated with coupling the energy from the high-frequency (HF) power supply into the arc tube. For example, air-filled helical resonators were designed to couple HF power to arc tubes in EHID lamps. Helical resonators produce axial electric fields in close proximity to the arc tubes to excite the discharge media within the arc tube. The size of the resonator depends inversely on the frequency. High frequency ISM bands around 915 and 2450 MHz were chosen to prevent electromagnetic interference (EMI) issues. However, as the lamps shrink in size, the field applicator becomes larger than the lamp causing optical shadowing effects.

SUMMARY OF THE INVENTION

It is an object of the invention to obviate the disadvantages of the prior art.

It is another object of the invention to provide a field applicator that permits improved miniaturization of EHID lamps.

The field applicator of this invention has a helical resonator that is loaded with a dielectric material of high relative permittivity (viz. compared to vacuum, $\in=\in_{material}/\in_{vacuum}$; where $\in_{vacuum}=1$). In particular, the dielectric material has a relative permittivity of greater than about 3, preferably greater than about 5, and more preferably at least about 10. The dielectric material allows the size of the resonator to be reduced and increases the field strength near the discharge vessel of the lamp. By comparison, air has a relative permittivity of about 1 whereas the preferred dielectric materials for use in this invention include fused silica with a relative permittivity of about 5 and polycrystalline alumina with a relative permittivity of about 10. Other ceramic materials may also be used, e.g. titanium ceramics which have a relative permittivity of about 40 or higher.

The effective, or guide, wavelength, $\lambda_g$, of an electromagnetic wave of free-space wavelength, $\lambda_o$, propagating in a material medium characterized by a relative permittivity, $\in$, is:

$$\lambda_g = \frac{\lambda_o}{\sqrt{\varepsilon}} \quad \text{Eq. (1)}$$

The use of the high relative permittivity dielectric reduces the guide wavelength and makes the helical resonator smaller. This obscures less of the light from the discharge vessel which must shrink in size as the wattage is reduced.

Another advantage is that a smaller applicator may be made with an increase in the electric field strength in the vicinity of the discharge vessel to assist in starting. The discharge vessel when in contact with the high $\in$ material essentially forms a lossy capacitor between the two helical resonators. Near the interface between the discharge vessel and the resonator the field is believed to be higher than if the resonator were unloaded.

A further advantage of the instant invention is that lower frequencies could be used without much change in applicator size. Moving to lower frequencies is desirable since HF power electronics are more efficient at frequencies below 900 MHz. An unanticipated benefit of the instant invention is to prevent inter-turn breakdown of the air between coils at small pitch, since the air is replaced by the dielectric material.

For example, operation around 600-800 MHz would permit using relatively inexpensive power electronics, e.g. LDMOS technology, rather than more expensive and less efficient GaAs transistors for the higher frequencies. While these are examples of lower frequencies they are not all inclusive. Lamps have been operated as low as 400 MHz. A tradeoff that occurs with size of the lamp and excitation with the helical resonators is unwanted radiation or EMI. As the circumferential length of the helix ($\pi d$) increases to approach one-half loaded wavelength, the helix functions as an antenna and can radiate power effectively into space. Thus it is preferred to keep the loaded circumferential length less than this so the power is coupled into the plasma rather than into space as EMI. This preferred relationship can be written as:

$$\pi d \leq \frac{\lambda_o}{2\sqrt{\varepsilon}} \quad \text{Eq. (2)}$$

In accordance with the above objects and advantages, there is provided a dielectric-loaded field applicator for an EHID lamp, comprising a helical resonator having a cylindrical dielectric core and a helical conductor, the dielectric core having a helical groove extending along its surface substantially from end to end; the helical conductor being contained in the helical groove and connectable at one end to a power source, the dielectric core having a recess for holding a discharge vessel and being comprised of a dielectric material having a relative permittivity greater than about 3.

In accordance with another aspect of the invention, there is provided an EHID lamp assembly, comprising two opposed dielectric-loaded field applicators and a discharge vessel disposed between the applicators; the discharge vessel containing a discharge medium and being supported at opposite ends by the applicators; the applicators each comprising a helical resonator having a cylindrical dielectric core and a helical conductor, the dielectric core having a helical groove extending along its surface substantially from end to end, the helical conductor being contained in the helical groove and connectable at one end to a power source, the dielectric core being comprised of a dielectric material having a relative permittivity greater than about 3; and the discharge vessel and the two applicators being arranged along, and coaxial with, a common axis.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

For the dielectric-loaded field applicator of this invention, a helical resonator is designed so the guide wavelength is dependent on the dimensions of the helical conductor and the dielectric constant of the loading material (Eq. 1). The diameter of the helical conductor is roughly inversely proportional to the square root of the relative dielectric permittivity (Eq. 2). So the radius of the helical conductor may remain constant but the length is reduced to maintain a quarter wavelength resonating condition along the entire helix. (See, e.g., U.S. Pat. No. 5,113,121) Shortening the length decreases the overall dimensions of the discharge vessel/applicator combination and improves mechanical stability. Reducing the diameter reduces the shadowing of the discharge vessel by the field applicator. As the diameter of the discharge vessel is reduced the power handling capability is also reduced, since heat flowing to the walls of the discharge vessel must be dissipated by convection, conduction or infrared radiation. The lateral surface area of the discharge vessel reduces proportionally to its diameter. The exact size of the discharge vessel and power handling capability will depend on the chemistry contained inside, the efficiency of conversion of the plasma power into light transmitted through the wall of the discharge vessel, and the wall material, and its spectral emissivity. For example, 30 W of power can be dissipated in an EHID lamp using a silica (quartz) discharge vessel containing Hg and Na—Sc-iodide filling and with an internal diameter of 2 mm, an external diameter of 3 mm and an internal length of 6 mm with ambient cooling and good maintenance and lifetime on the order of 10,000 hr.

The resonator contains a ground shield not removed to infinity and the central portion of the resonator is filled with a dielectric material having a high relative permittivity, preferably a polycrystalline alumina (PCA) ceramic which is molded, extruded, or cut to have helical grooves in which the conductive member of the resonator, e.g, a wire helix, is placed. Such a helix could be screwed onto the PCA. The PCA has a recess in the end to support the arc tube. A facing helical resonator has another recess which supports the discharge vessel from the other end. Alternatively refractory cements could be used to fix the discharge vessel in position.

Figure 4:
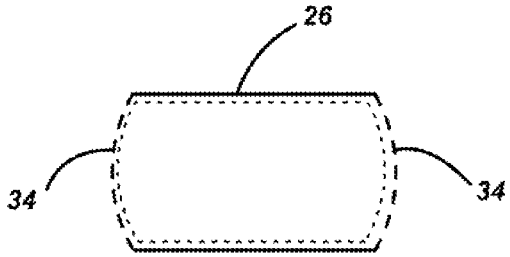
FIG. 4 is a further view of the discharge vessel shown in FIG. 1.

With reference to the Figures, there is shown an EHID lamp assembly 1 comprising two dielectric-loaded field applicators 2, discharge vessel 26, and insulator supports 20. The discharge vessel 26 may be comprised of quartz or a transparent or translucent ceramic such as polycrystalline alumina, sapphire, aluminum nitride, aluminum oxynitride or yttrium aluminum garnet. The discharge vessel 26 has a discharge chamber 16 which contains a chemical fill 18 and a fill gas. The fill gas is generally an inert gas such as xenon, although other gases such as argon and krypton may also be used. The chemical fill may be only mercury or may also comprise any one of the generally known chemical fills used in high intensity discharge lamps, e.g., metal halides and/or pure metals. The shape of the discharge vessel 26 is generally cylindrical with slightly curved ends 34. (See, FIG. 4) However, the discharge vessel may also comprise other geometric shapes such as a right-circular cylinder, ellipse, or sphere. The power source is a high frequency oscillator, or oscillator amplifier configuration generating substantially a single sinusoidal frequency in the range 400 MHz to 12 GHz with the preferred operation within ISM bands around 915 MHz and 2.545 GHz. The active devices in the oscillator are either vacuum tube devices such as magnetrons or preferably solid-state components such as LDMOS transistors, GaAs FET's, SiC transistors or similar solid-state components. The power source may also contain an active or passive impedance matching network to provide impedance matching between the source and the load (resonator and discharge vessel) as the plasma contained therein goes through the ignition, glow and arc phases. Such impedance matching is necessary to prevent reflected power from damaging the output stages of the power source.

Figure 1:
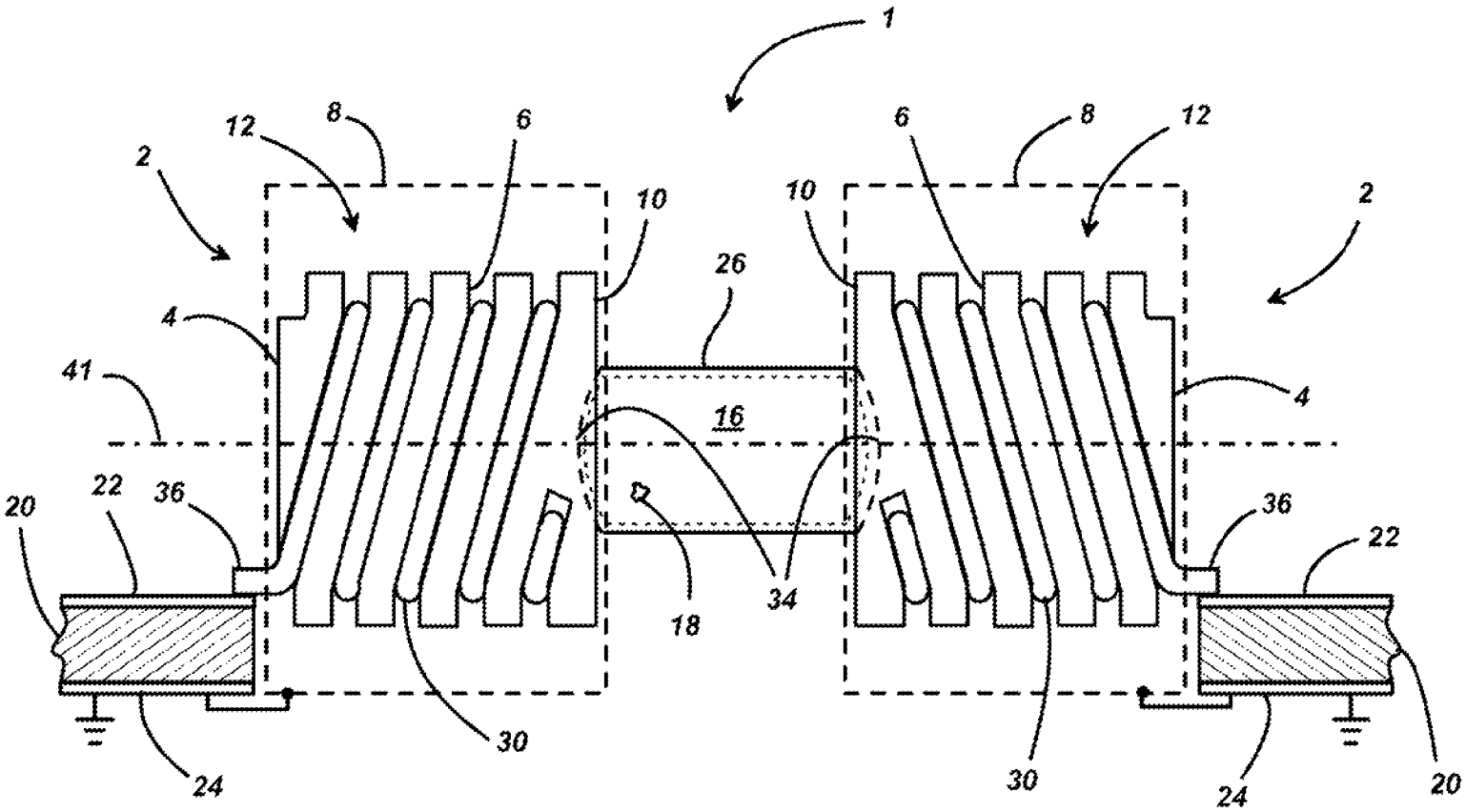
FIG. 1 is a side view of an EHID lamp assembly showing the dielectric-loaded field applicators in combination with the discharge vessel.
Figure 2:
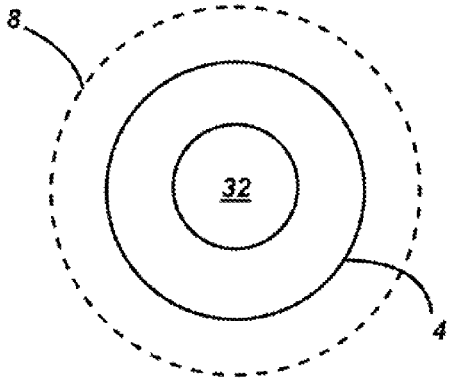
FIG. 2 is a view of the end of a dielectric-loaded field applicator proximate to the discharge vessel.
Figure 3:
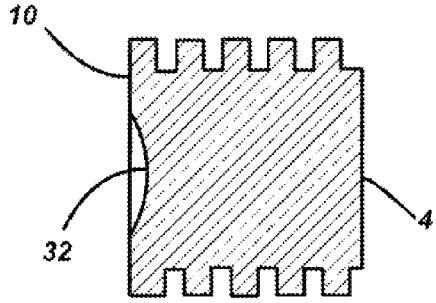
FIG. 3 is cross-sectional view of the dielectric core of the helical resonator.

The dielectric-loaded field applicators 2 are supported at one end by insulator supports 20 that have a ground lead 24 on one side and a power lead 22 on the opposite side. Such a support could be a micro-stripline formed on an alumina substrate as is well known in the microwave circuits industry. The dielectric-loaded field applicators comprise a helical resonator 12 and an electromagnetic interference (EMI) shield 8. The EMI shield 8 (illustrated in FIG. 1 in cross section) preferably comprises a cylindrical mesh of a conductive material that is substantially concentric with the helical resonator 12. Alternatively, the cylindrical mesh may be replaced by a transparent quartz tube coated with a transparent conductive medium such as an indium-tin oxide film. The diameter of the EMI shield should be 1.5 to 10 times larger than the diameter of the helical conductor. In the preferred embodiment shown in FIG. 1, the EMI shield 8 extends slightly beyond each end of the helical resonator and is grounded through the ground lead 24. The helical resonator 12 is comprised of dielectric core 4 and helical conductor 30. The dielectric core is preferably made of a cylindrical piece of polycrystalline alumina that has been formed (e.g. by injection molding or isostatic pressing) or machined to have a helical groove 6 that extends along its outer surface substantially from end to end. The helical groove 6 contains the helical conductor 30 which is preferably in the form of a metal wire that has been wound into the helical groove 6. Alternatively, the helical conductor may comprise a metallic fill that has been molded or otherwise deposited into the groove 6. The helical conductor 30 of resonator 12 is connected to power lead 22 at the distal end 36 of helical conductor 30. The proximate end 10 of the dielectric core 4 has a recess 32 for holding the discharge vessel 26 in place (FIGS. 2 and 3). Preferably the recess 32 has a contour that matches the ends 34 of the discharge vessel so that the discharge vessel is held firmly between, and in contact with, the two dielectric-loaded field applicators 2. The recess 32 is preferably concentric with the helical resonator with the discharge vessels and the field applicators arranged along, and coaxial with, common axis 41.

While there have been shown and described what are at present considered to be the preferred embodiments of the invention, it will be apparent to those skilled in the art that various changes and modifications can be made herein without departing from the scope of the invention as defined by the appended claims.

I claim:

1. A dielectric-loaded field applicator for an EHID lamp, comprising:

a helical resonator having a cylindrical dielectric core and a helical conductor, the dielectric core having a helical groove extending along its surface substantially from end to end;

the helical conductor being contained in the helical groove and connectable at one end to a power source, the dielectric core having a recess for holding a discharge vessel and being comprised of a dielectric material having a relative permittivity greater than about 3.

2. The applicator of claim 1, wherein the dielectric material has a relative permittivity greater than about 5.

3. The applicator of claim 1, wherein the dielectric material has a relative permittivity of at least about 10.

4. The applicator of claim 1, wherein the dielectric material is fused silica.

5. The applicator of claim 1, wherein the dielectric material is polycrystalline alumina.

6. The applicator of claim 1, wherein the applicator has an EMI shield surrounding the helical resonator.

7. The applicator of claim 6, wherein the EMI shield is cylindrical in shape and substantially concentric with the helical resonator.

8. The applicator of claim 1, wherein the helical conductor has a circumferential length defined by $$\pi d \leq \frac{\lambda_o}{2\sqrt{\varepsilon}}.$$

9. An EHID lamp assembly, comprising:

two opposed dielectric-loaded field applicators and a discharge vessel disposed between the applicators;

the discharge vessel containing a discharge medium and being supported at opposite ends by the applicators;

the applicators each comprising a helical resonator having a cylindrical dielectric core and a helical conductor, the dielectric core having a helical groove extending along its surface substantially from end to end, the helical conductor being contained in the helical groove and connectable at one end to a power source, the dielectric core being comprised of a dielectric material having a relative permittivity greater than about 3; and the discharge vessel and the two applicators being arranged along, and coaxial with, a common axis.

10. The assembly of claim 9, wherein the dielectric core of each applicator has a recess for supporting the discharge vessel.

11. The assembly of claim 9 wherein the discharge vessel is supported between the applicators by a refractory cement.

12. The assembly of claim 9, wherein the dielectric core is comprised of polycrystalline alumina.

13. The assembly of claim 9 wherein the helical conductor is a metal wire.

14. The assembly of claim 9 wherein the helical conductor has a circumferential length defined by $$\pi d \leq \frac{\lambda_o}{2\sqrt{\varepsilon}}.$$

15. The assembly of claim 9 wherein each applicator has an EMI shield that is cylindrical in shape and is substantially concentric with the helical resonator.

16. The assembly of claim 15 wherein the EMI shield is comprised of a quartz tube having a conductive coating of indium tin oxide.

17. An EHID lamp assembly, comprising:

two opposed dielectric-loaded field applicators and a discharge vessel disposed between the applicators;

the discharge vessel containing a discharge medium and being supported at opposite ends by the applicators;

the applicators each comprising a helical resonator having a cylindrical dielectric core and a helical conductor, the dielectric core having a helical groove extending along its surface substantially from end to end, the helical conductor being contained in the helical groove and connectable at one end to a power source, the dielectric core being comprised of polycrystalline alumina and having a recess for supporting the discharge vessel;

the discharge vessel and the two applicators being arranged along, and coaxial with, a common axis, and each applicator having an EMI shield that is cylindrical in shape and substantially concentric with the helical resonator.

18. The assembly of claim 17 wherein the discharge vessel is in contact with the dielectric core of each applicator.

19. The assembly of claim 17 wherein the EMI shield is comprised of a quartz tube having a conductive coating of indium tin oxide.

20. The assembly of claim 17 wherein the EMI shield is comprised of a metal wire mesh.

* * * * *